United States Patent [19]

Carroll et al.

[11] 4,226,040

[45] Oct. 7, 1980

[54] FOLDING SCAFFOLD SIGN

[75] Inventors: Michael A. Carroll; John L. Carroll, both of St. Louis, Mo.

[73] Assignee: R & J Sign Company, Inc., St. Louis, Mo.

[21] Appl. No.: 53,281

[22] Filed: Jun. 29, 1979

[51] Int. Cl.[3] ..... G09F 15/00

[52] U.S. Cl. ..... 40/610; 248/460; 40/612

[58] Field of Search ..... 40/606, 610, 612, 903; 428/116–118; 248/188, 188.8, 456, 460; 312/231; 52/71, 38, 309.15, 800, 806; 16/150; 116/63 P

[56] References Cited

U.S. PATENT DOCUMENTS

| | | | |
|---|---|---|---|
| 1,135,241 | 4/1915 | Woods | 40/610 |
| 1,421,603 | 7/1922 | Stanton | 40/606 |
| 1,687,881 | 10/1928 | Myers | 40/539 |
| 1,854,225 | 4/1932 | Rosenthal | 40/539 |
| 3,324,930 | 6/1967 | Colombo | 16/150 |
| 3,889,409 | 6/1975 | Thomas | 40/11 A |
| 3,919,445 | 11/1975 | Smarook | 428/116 |

FOREIGN PATENT DOCUMENTS

| | | | |
|---|---|---|---|
| 461449 | 1/1951 | Italy | 40/606 |

*Primary Examiner*—Bernard Nozick
*Attorney, Agent, or Firm*—Glenn K. Robbins

[57] ABSTRACT

A folding scaffold sign. The sign is constructed of a special honeycombed plastic material in which two sign panels are provided, separated by a fold line. The bottom corners of the panels are provided with metal legs inserted through openings forming the honeycomb structure. The legs are retained in the openings by elasticity and friction of the plastic memory material and the sign can be used as a triangular free-standing sign supported upon a floor surface, ground or the like. The sign may further be used as a cover for an existing conventional post-supported sign by placing the folded sign thereover and folding the panels together and retaining the legs in secured condition by a retaining chain. The folded-over sign may be stored in the same presentation when the panels are folded over against one another in superimposed position.

7 Claims, 9 Drawing Figures

FOLDING SCAFFOLD SIGN

SUMMARY OF THE INVENTION

In the past, various types of scaffold or tripod signs have been used which have been of one type or another and generally bulky and cumbersome in construction. Such signs are of varying degrees of complexity to erect and provide a storage problem when knocked down. Further, difficulties have been encountered in weathering resistance.

By means of the instant invention there has been provided a folding scaffold sign which is simple in construction, economical in cost, and of great ease and simplicity in erection and use. The sign is constructed of an extruded memory type thermo-plastic material having a honeycomb cross-section. In this fashion, the sign when constructed of two panels separated by a folding means has a good degree of strength and rigidity and lends itself to easy connection of the legs to the sign. The connection of the legs is simply effected by inserting metallic rods which are slightly larger in diameter than the openings so that when inserted the elasticity and plastic memory of the panel construction holds the legs firmly in place.

Further, the two panels comprising this sign are separated by folding means, constructed in such fashion that a fold line presents the two panels in an angular relationship of about 45 degrees which may be varied to some extent. In this fashion the sign can be simply supported in free-standing position on a ground surface with the legs being constructed of metal providing a low center of gravity and stability to resist light winds.

Further, through the folding means the natural elasticity occasioned by the plastic memory construction tends to push the panels slightly apart when they are folded together so that by special retaining means comprising a chain-like link connected to one of the legs having a hook at the end a secure connection to opposite legs may be provided to hold the panels together in folded position. The folding means is simply effected by laying a hot wire-like heating means across the width of the panel to soften the plastic and when so softened, bending the plastic to form the two panels at the desired angular relationship until a set has occurred. The folding means preferably comprises two fold lines separated by an inch or so in order that the scaffold sign may be placed over existing post supported signs. A single fold line may be used otherwise, as desired, in this fashion, the folding sign can be used to present a different display over a conventional post-supported sign and can be removed when the need for use is over. The folding scaffold sign is placed over an existing post-supported panel sign by simply placing the sing over the conventional panel and folding the two panels together and securing the legs by the chain-like retaining means.

The folding scaffold sign is simple in construction and economical in manufacture and can be used not only as a free standing sign standing upon the ground or it can be used as a cover for existing sings.

Other objects of this invention will appear in the detailed description which follows and will be otherwise apparent to those skilled in the art.

For the purpose of illustration of this invention there is shown in the accompanying drawings a preferred embodiment thereof. It is to be understood that these drawings are for the purpose of illustration only and that the invention is not limited thereto.

IN THE DRAWINGS

DESCRIPTION OF THE INVENTION

Figure 1:
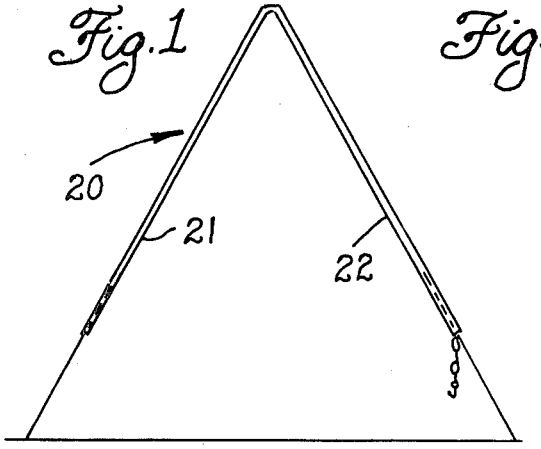
FIG. 1, is a view inside elevation of the sign erected in free standing position.
Figure 2:
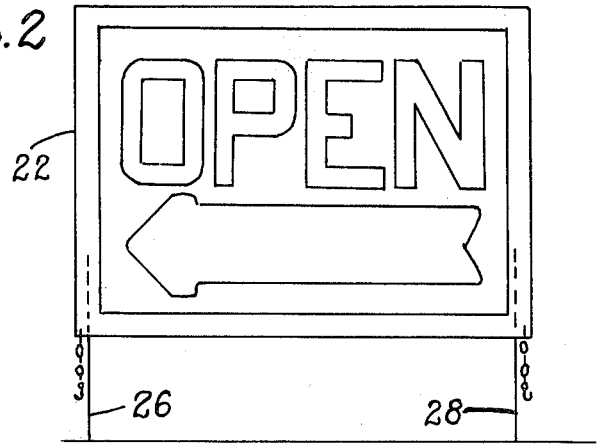
FIG. 2, is a view in front elevation of the erected sign.
Figure 3:
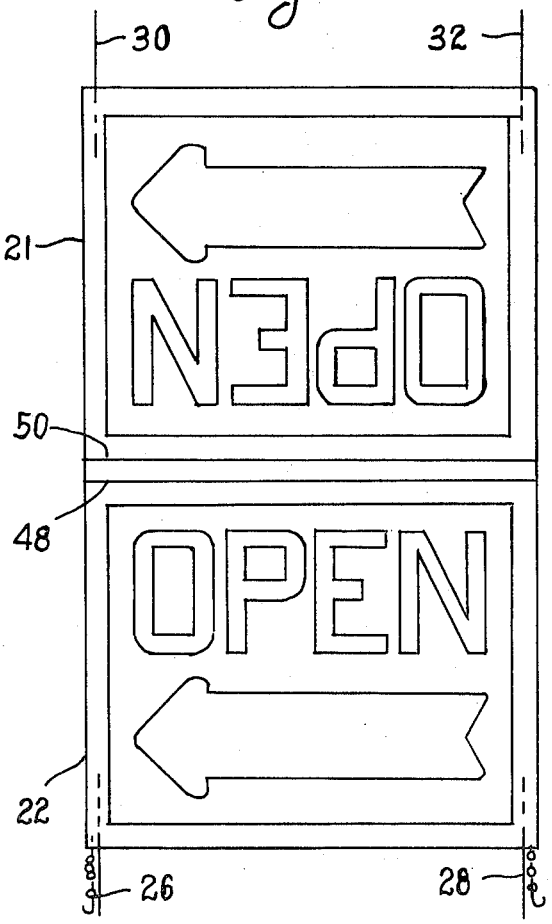
FIG. 3, is a top plan view of the sign fully spread out.

The folding scaffold sign of this invention is generally identified by the reference numeral 20 in FIGS. 1, 2 and 3. It is comprised of a pair of panels 21 and 22 separated by an intermediate folding means 24. Legs 26 and 28 are connected to the bottom corners of panel 22 while legs 30 and 32 are connected to the panel 21. The legs are preferably of metal to provide added weight at the bottom of the free-standing sign to lower the center of gravity and enhance the stability. When the panel is placed upon a flat ground surface, floor surface of the like the sign is erected in free-standing position as shown in FIGS. 1 and 2. In this fashion it may be used for various types of displays as desired.

Figure 6:
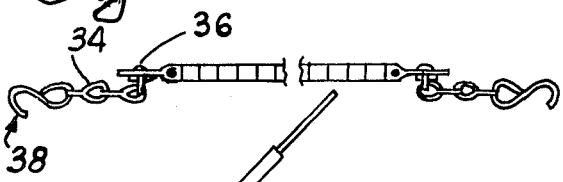
FIG. 6, is an enlarged view broken away of a panel showing the connection of the leg in the honeycomb panel.
Figure 4:
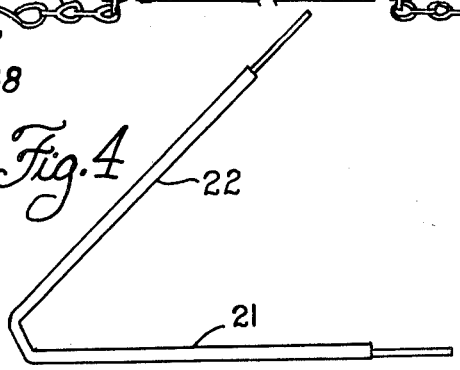
FIG. 4, is a view inside elevation of the sign in unsupported position.
Figure 5:
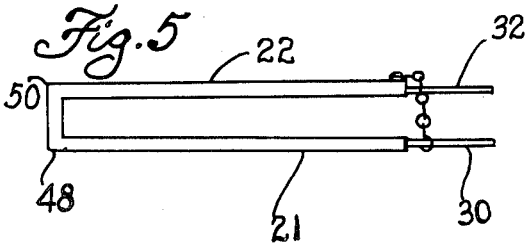
FIG. 5, is a view inside elevation of the sign showing the legs chained together for storage.

In order to provide for retaining the panels in a folded over position for storage or the like, a retaining or securing chain 34 is provided. This chain is anchored by a bolt or the like 36 to the lower corners of panel 22 as best shown in FIGS. 2 and 6. A hook 38 is provided at the end in order that the chain may be hooked over an opposite leg as shown in FIG. 5.

Figure 7:
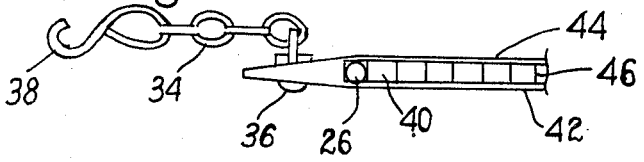
FIG. 7, is a further enlarged gragmentary end view showing the chain connection and the leg connection in the honeycomb panel.

The folding scaffold sign is constructed of an extruded polyethylene or polypropylene sheet-like material having a plastic memory which aids in the holding the two panels in the free-standing position shown in FIG. 1. The plastic material has a special honeycomb or fluted cross-section with a plurality of elongated openings extending perpendicular to the fold means. These openings are best shown in FIGS. 6 and 7 as openings 40 which are provided in the extruded construction of the panel to provide the panel faces 42 and 44 with ribs 46 defining the openings 40. This honeycomb structure particularly lends itself to a simple and efficient and stable construction and connection of the legs to the panel. This is provided as shown in FIG. 7 by insertion of a leg 26 into the opening 40 of the panel. The leg construction is of slightly larger diameter than the width of the square-shaped openings so that the plastic material forming the panel is slightly distorted and retains the leg when inserted by friction and the natural elasticity of the plastic memory plastic. Thus the legs are connected and held in the plastic panels by the natural elasticity of the honeycomb structure in the particular individual opening within which the leg is inserted.

Where desired, cement or glue may be used to insure such retention.

In order to provide for the easy folding of the two panels along the folding means 24 a pair of fold lines 48 and 50 as best shown in FIGS. 3, 4, 5 and 9 are provided. The fold lines may be obtained by laying a hot heating wire along the fold line to be constructed in the plastic memory thermoplastic panel material. When so softened the fold lines 48 and 50 will be obtained and in the heated condition the panels are bent to the position shown in FIG. 4 and allowed to cool to provide a set of plastic panels to this position. It will also be understood that a slight degree of scoring may also be used as desired.

Figure 9:
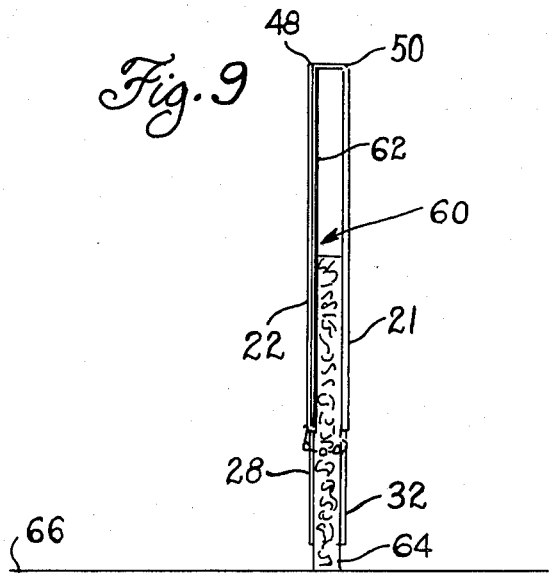
FIG. 9, is a side view taken from the right side of FIG. 8.

The two-fold lines 48 and 50 are spaced apart a slight distance of an inch, for example, to approximate the width of a conventional panel sign shown in FIG. 9. This is done to receive not only the width of the panel but also the width of the post to which it may be connected in order that the folding scaffold sign can be used as a cover. The conventional sign 60 is comprised of a panel 62 connected to a ground post 64 to a ground surface 66.

USE

The folding scaffold sign 20 of this invention is adapted to be very simply used and stored in a number of fields. For example, in the real estate field the sign may be erected to the free-standing position shown in FIGS. 1 and 2 where the weight of the panels will hold the sign in the spread apart position shown in FIG. 1. The weight of the metal legs inserted in the panels aids in providing a low center of gravity at the bottom of the sign to provide stability and resist forces of wind and the like. The sign may be used in all types of weather since the plastic panels are weather and sun resistant.

When the sign is desired to be stored the panels are simply folded over against one another in superimposed position shown in FIG. 5. The retaining chain 34 is then used to hook the legs together with the hook 38 being secured around the opposite legs of the sing to hold the folded over panels in the position shown in FIG. 5.

Figure 8:
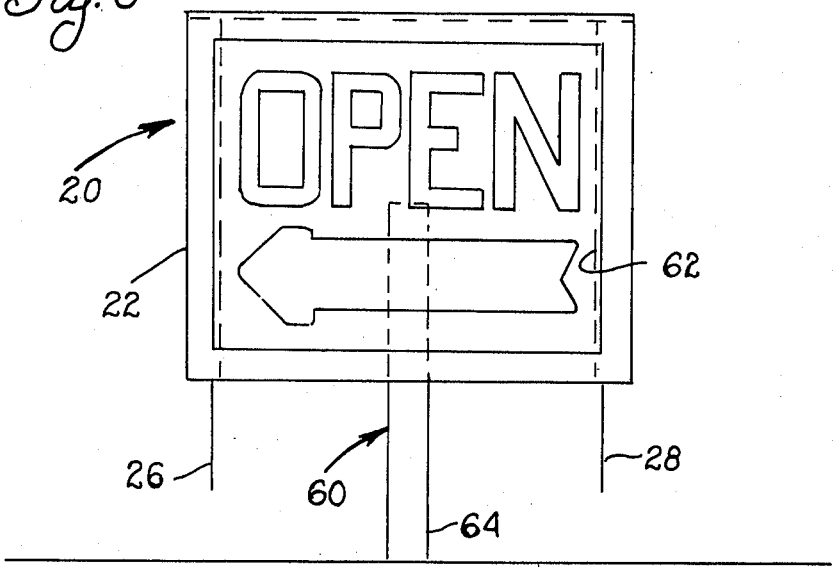
FIG. 8, is a view in elevation showing the folding sign connected over an existing panel sign having a vertical rod ground support.

The sign is also of great use as a cover for existing conventional panel signs 60 such as shown in FIGS. 8 and 9. The sign may be imprinted with different displays and a multiplicity of signs can be used as desired to cover a conventional panel sign having the ground support post 64. The folding scaffold sign when used as a cover for the existing sign is simply placed over the conventional panel 62 of the ground supported sign in the position shown in FIGS. 8 and 9. The legs are then connected to one another as in the storage operation by use of the reataining chain 34 with the hook 38 used to hook the legs together and retain the sign as a cover over the conventional panel sign. When the sign is desired to be removed the legs are simply unhooked and the scaffold sign is folded together for storage or use again as desired.

Various changes and modifications may be made within this invention as will be readily apparent to those skilled in the art. Such changes and modifications are within the scope and teaching of this invention as defined by the claims appended hereto.

What is claimed is:

1. A weather resistant plastic folding scaffold sign comprised of a pair of panels connected together by a fold means, leg members connected to each of said panels extending away from said fold means, said panels being comprised of a honeycomb structure having openings extending perpendicularly to said fold means and said leg members being connected to said panels by interfitting in selected openings of said honeycomb structure.

2. The scaffold sign of claim 1, in which said plastic has a plastic memory and said fold means provides an angular relationship between said panels between a folded back position where the two panels are superimposed and a fully extended planar position to facilitate free standing support by said legs when the sign is supported on a ground surface.

3. The scaffold sign of claim 1, in which the panels are adapted to be folded over in superimposed position and retaining means are provided to secure the legs of one panel to the legs of the other panel to hold the panels in the folded over position for storage.

4. The scaffold sign of claim 1, in which said plastic has a plastic memory and said fold means provides an angular relationship between said panels between a folded back position where the two panels are superimposed and a fully extended planar position to facilitate face standing support by said legs when the sign is supported on a ground surface and the panels are adapted to be folded over in superimposed position and retaining means are provided to secure the legs of one panel to the legs of the other panel to hold the panels in the folded over position for storage.

5. The scaffold sign of claim 1, in which means are provided for retaining the scaffold sign over a conventional post supported panel sign, said scaffold sign being fitted over the conventional panel sign with the legs of the panel depending from panel sign and retaining means are provided to secure the legs of one panel to the legs of the other panel.

6. The scaffold sign of claim 6, in which the fold means comprises a pair of spaced fold lines spaced apart a distance to receive said conventional panel sign between the scaffold sign panels when folded in a parallel relationship with the conventional panel sign sandwiched between.

7. The scaffold sign of claim 3 and claim 5, in which the retaining means comprises a plurality of chain-like members connected to said legs adapted to be secured by hook elements to opposed legs.

* * * * *